United States Patent [19]

Zearfoss, Jr.

[11] 4,019,337

[45] Apr. 26, 1977

[54] REFRIGERATION APPARATUS AND METHOD

[76] Inventor: Elmer W. Zearfoss, Jr., 929 Magee Ave., Philadelphia, Pa. 19111

[22] Filed: Apr. 8, 1976

[21] Appl. No.: 674,849

Related U.S. Application Data

[63] Continuation-in-part of Ser. No. 517,141, Oct. 23, 1974, Pat. No. 3,955,374.

[52] U.S. Cl. ..... 62/113; 62/197; 62/225; 62/509

[51] Int. Cl.[2] ..... F25B 39/04

[58] Field of Search ..... 62/511, 113, 197, 513, 62/225, 509

[56] References Cited

UNITED STATES PATENTS

| | | | |
|---|---|---|---|
| 2,393,854 | 1/1946 | Carpenter | 62/511 |
| 2,794,324 | 6/1957 | Zearfoss, Jr. | 62/509 X |
| 3,285,032 | 11/1966 | Vanderlee | 62/225 |

*Primary Examiner*—William E. Wayner
*Attorney, Agent, or Firm*—Harry W. Hargis, III

[57] ABSTRACT

Refrigeration apparatus comprising a compressor, a condenser, an evaporator, a suction line connecting the evaporator to the intake of the compressor, and first and second capillary tubes for feeding refrigerant to the evaporator. Refrigerant flow control means is associated with said first capillary tube, a portion of the flow control means being disposed in heat exchange with the evaporator outlet. The flow control means includes a diverter conduit for a portion of the liquid refrigerant fed to the evaporator by said second capillary tube and affording heat exchange of said portion with refrigerant flowing from the condenser to the evaporator through said first capillary tube.

An increase in superheat sensed by the control means through its heat exchange relation with the evaporator outlet — an indication of a starved evaporator — will cause the control means to effect liquid refrigerant flow through the diverter conduit, where it will operate by way of the described heat exchange to subcool liquid refrigerant flowing through the capillary tube restrictor from the condenser to the evaporator, thereby increasing the refrigerant mass-flow rate and restoring the evaporator to its non-starved operating condition.

18 Claims, 5 Drawing Figures

REFRIGERATION APPARATUS AND METHOD

CROSS REFERENCE TO RELATED DISCLOSURE

This is a continuation-in-part of my copending U.S. patent application Ser. No. 517,141, filed Oct. 23, 1974, now U.S. Pat. No. 3,955,374, issued May 11, 1976.

BACKGROUND OF THE INVENTION

This invention relates to refrigeration, and more particularly to improvements in both apparatus and operating aspects of refrigeration systems of the vapor-compression type utilizing capillary tube restrictors as the expansion or throttling means.

In relatively large capacity refrigeration systems where high efficiency and wide variations in operating conditions must be dealt with, capillary tube restrictors have met with limited success. Instead, resort has been had to the more effective but costly superheat sensing, thermostatically controlled expansion valve as the refrigerant throttling means.

It is an objective of my invention to provide, in a refrigeration system, improved capillary tube restrictor means overcoming the above briefly described shortcomings of such restrictor means and achieving the operating advantages and design flexibility of more costly thermostatic expansion valves.

It is a further general objective of my invention to provide improved capillary tube restrictor means affording increased efficiency of operation over a range of various operating conditions.

It is a further objective of my invention to provide both means for and a method of achieving optimum refrigerant flow rate in a system utilizing a capillary tube restrictor as the throttling device.

SUMMARY OF THE INVENTION

In achievement of the foregoing as well as other objectives, the invention contemplates improvements in refrigeration apparatus of the type comprising refrigerant evaporator means, suction line means, compressor means, condenser means, and a main conduit including capillary tube restrictor means disposed in conventional refrigerant flow communication, in the order stated. Improvement resides in refrigerant flow rate control means operable to modulate refrigerant flow through the restrictor means by controlling subcooling of such refrigerant in accordance with changes in superheat temperature of refrigerant leaving the evaporator.

The improvement comprises flow control means, which, in one aspect of the invention, includes a pilot circuit having a capillary tube leading from the condenser means to diverter passage means through which liquid refrigerant may be caused to flow for heat exchange with said main conduit means, thence to the evaporator means. Vapor lift means energizable in accordance with an increase in evaporator superheat is operable to effect refrigerant flow through said diverter passage means to subcool refrigerant flowing in said first conduit means, whereby to increase the refrigerant flow rate in said system and reduce said superheat.

The manner in which the foregoing as well as other objectives and advantages of the invention may best be achieved will be more fully understood from a consideration of the following description, taken in light of the accompanying drawing.

DESCRIPTION OF THE SEVERAL EMBODIMENTS

Figure 1:
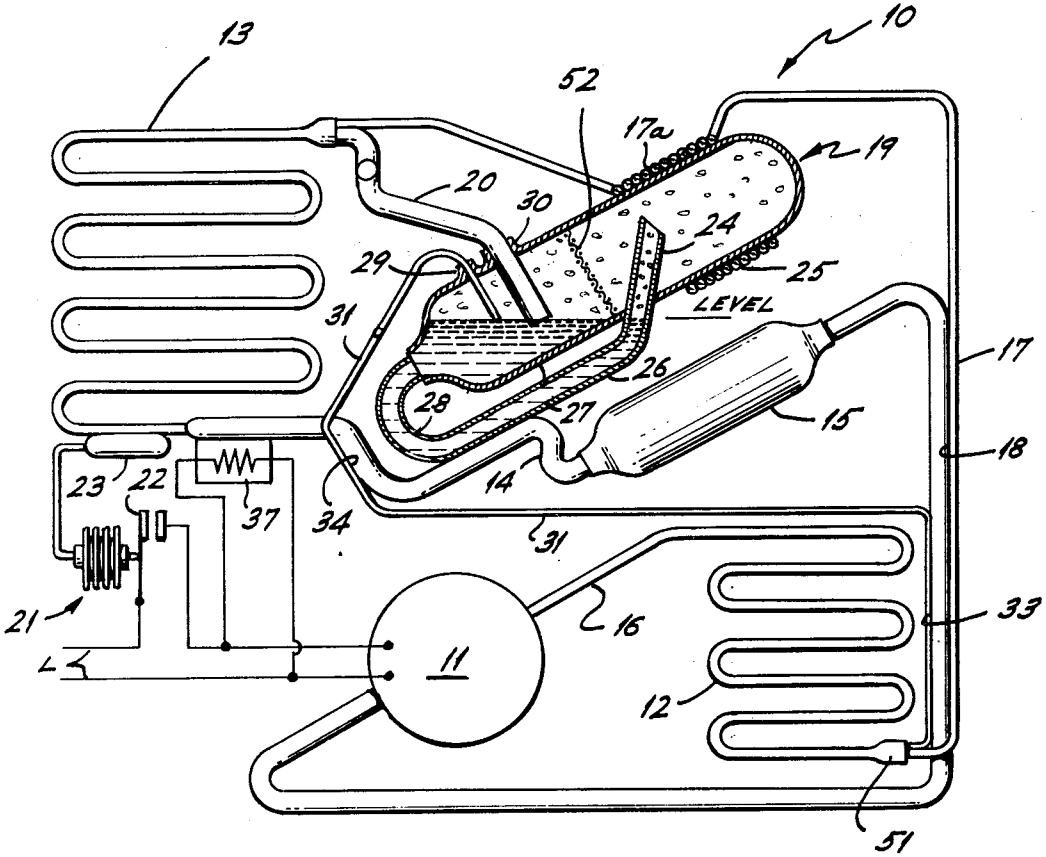
FIG. 1 is a partially sectioned diagrammatic view of a refrigeration system embodying the invention.

With more detailed reference to the drawing, there is illustrated in FIG. 1 a refrigeration system 10 including a motor-compressor 11, a condenser 12, an evaporator 13, a suction line 14, and an accumulator 15 in the suction line. A discharge line 16 connects motor-compressor 11 to condenser 12, and a main conduit comprising a capillary tube restrictor 17 connects condenser 12 to the inlet of evaporator 13. Suction line 14 and accumulator 15 connect the outlet of evaporator 13 to the intake of motor compressor 11. Portions of suction line 14 and the capillary tube restrictor 17 are disposed in heat exchange relation as seen at 18.

In especial accordance with the invention, control means 19 comprises a pilot conduit in parallel refrigerant flow circuit with the main conduit and including a second capillary tube 31 leading from connection 51 at the outlet of condenser 12. Control means 19 further comprises a looped configuration of tubular conduit portions 26 and 27 having spaced, substantially parallel axes inclined to the horizontal. This angularity, while not critical, tends to optimize the performance of the illustrated device configuration, when compared to a vertical disposition of such configuration. A vertical, upper portion 24 affords fluid flow communication between upper regions of conduit portions 26 and 27, and a lower loop portion 28 interconnects the lower regions of conduit portions 26 and 27. Portion 24 is disposed generally vertically to direct fluid flowing therefrom onto the inner walls of the upper region of conduit portion 27. An inlet port for conduit portion 27 is provided at 29, in proximity to an outlet port 30.

Capillary tube 31 leading from the outlet of condenser 12 is connected to inlet port 29 of conduit portion 27, and a tube 20 leading from outlet port 30 to the inlet of evaporator 13 completes the pilot conduit. Further to the invention, capillary tube restrictor 17 includes a portion **17*a* coiled about conduit portion 27, in heat exchange relation therewith as seen at 25, in the hereinabove described region of impingement of refrigerant flowing from portion 24 onto the inner wall of the conduit portion 27**.

A bellows-actuated thermostat 21 includes an evaporator temperature sensing bulb 23, and a compressor energizing switch 22 connected in series electrical circuit with a source of energy L and the motor of motor-compressor 11. Cyclic operation of the motor compressor 11 is afforded by thermostat 21, in accordance with cut-in and cut-out temperatures of the thermostat.

In operation, and assuming that switch 22 is open and that an elevation in evaporator temperature causes switch 22 to close, motor-compressor 11 will be energized causing gaseous refrigerant to flow from evaporator 13 through accumulator 15 and suction line 14 into compressor 11, where its pressure is raised for flow therefrom into condenser 12. Liquified refrigerant flows from condenser 12 in a greater quantity through capillary tube restrictor 17 of the main conduit into evaporator 13, and, in lesser quantity, through the capillary tube 31, of the pilot conduit, and into inlet port 29 of conduit portion 27. Some of this latter liquid flashes into gas, filling upper regions of conduit portions 26 and 27 and upper portion 24 of the former. Liquid filling the lower regions, including lower loop portion 28, to a level reaching the end of tube 20 in outlet port 30, flows outwardly through tube 20 into evaporator 13.

Operation in this manner continues until such time as loading of evaporator 13 is accompanied by a superheat temperature gain in the gaseous refrigerant leaving the evaporator 13. This superheat is absorbed through the heat exchange 32, as heat of vaporization, by colder liquid refrigerant in lower loop 28 and conduit portion 26, causing liquid to be vapor lifted upwardly through portion 24 (FIG. 2) for discharge onto inner walls of conduit portion 27. This liquid absorbs heat from relatively warmer refrigerant in coiled tubing 17*a* of the main conduit, subcooling the liquid refrigerant flowing through capillary tube restrictor 17, advantageously to increase such flow to the evaporator. When the evaporator refrigerant supply has been restored, the superheat at heat exchange 32 is reduced to halt the vapor lift of liquid upwardly through conduit portion 26 and portion 24 thereof, thereby substantially halting the absorption of heat from coil 17*a* at heat exchange 25.

Figure 2:
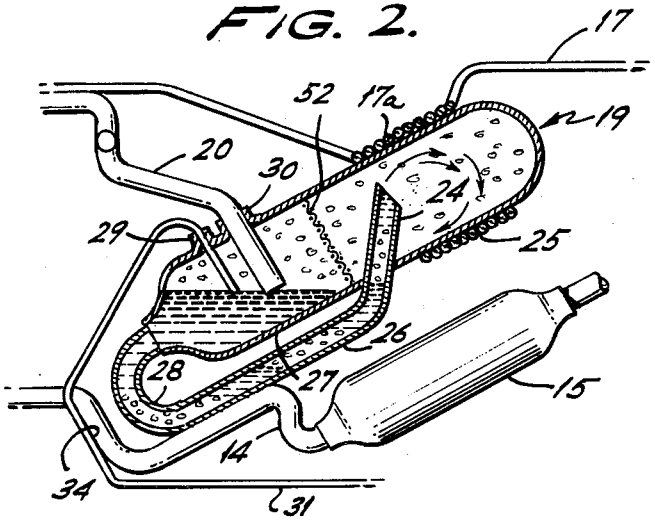
FIG. 2 is a fragmentary view of a portion of the system seen in FIG. 1, and illustrating an operational feature thereof.

It will be understood that the heat exchange 18 of capillary tube restrictor 17 with suction line 14 is optional, and may be omitted in some system applications. Also illustrated in FIGS. 1 and 2 are optional heat exchanges 33 and 34 between capillary tube 31 and suction line 14. Alternatively, heat exchange 34 may be thermally supplemented or replaced by an electrical heater 37 connected in parallel with the motor of motor-compressor 11. Either way, this latter described pair of heat exchange relationships serve to bias and/or intensify the degree of refrigerant superheat developed naturally in the evaporator 13, the exact dispositions of the heat exchange relationships (whether spaced upstream, as shown, or in closer proximity to heat exchange 32), being a matter of choice. As a further option, a refrigerant mist screen or baffle 52 may be located just above ports 29 and 30 to obviate the thermal effects on heat exchange 25 of random liquid turbulence, when the vapor lift is inactive.

Further modifications of the embodiment thus far described are contemplated by the scope of the claiming, some briefly described as follows: a single conduit may lead from the condenser 12, optionally in heat exchange with suction line 14, to a region downstream of heat exchange 25 and in which region such single conduit (via a connection such as 51) may branch into capillary tube restrictors 17 and 31; such single conduit then may be coiled about conduit portion 27 in provision of heat exchange 25; or the portion of capillary tube restrictor 31 between heat exchange 33 and inlet port 29 may also be coiled about the upper region of conduit portion 27, in heat exchange relation therewith.

It will be further understood that the main conduit may be one of several parallel circuits for feeding multiple evaporator sections, and that the pilot conduit leading from the compressor, condensor high side to the evaporator, suction line low side may be connected to any suitable portion of the low side. For example, connection may be made to the evaporator inlet as shown, or to the suction line. In any event, the combination of capillary tubes 17 and 31 is designed to provide adequate total system flow at the lowest suction temperature and highest ambient temperature, while operating substantially without evaporator superheat and/or vapor lift action. Flow capacity of pilot capillary tube 31 under such conditions must accomodate approximately 10 to 20 percent of the total system flow, to satisfy subcooling loads imposed by main capillary tube 17*a* at heat exchange 25, whenever increased evaporator loading causes the flow control means to respond. An upper limit for such a response can be realized by appropriate sizing of the heat exchange 25, thereby protecting the system from excessive overload.

Figure 3:
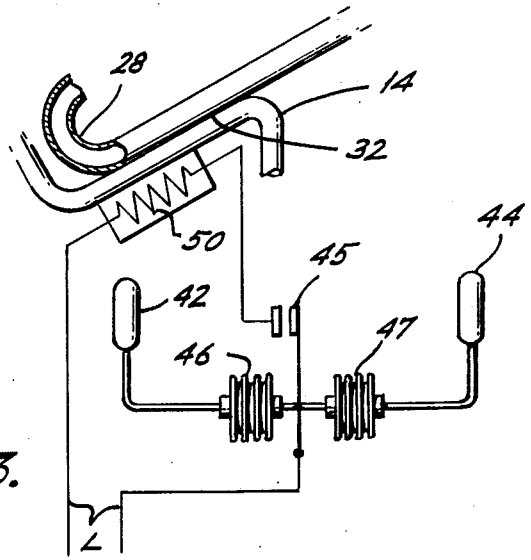
FIG. 3 is a view of a control for the apparatus seen in FIGS. 1 and 2, and illustrating a modification contemplated by the invention.

A modified embodiment of the invention is seen in FIG. 3, wherein an auxiliary electrical heater 50 is disposed in coexisting heat exchange relation with tube 26 and in proximity of heat exchange 32 of FIGS. 1 and 2. One side of heater 50 is connected to a source of electrical energy L, and the other side is connected to the same source of energy L through a switch 45 under control of opposed bellows 46 and 47. Bellows 46 is in fluid flow communication with evaporator inlet temperature sensing bulb 42, and bellows 47 is disposed in fluid flow communication with evaporator outlet temperature sensing bulb 44.

In operation of the embodiment seen in FIG. 3, as applied to FIGS. 1 and 2, sensing bulbs 42 and 44 detect, respectively, inlet and outlet evaporator temperatures, the resultant differential pressure in bellows 46 and 47 being a function of the degree of superheat of refrigerant flowing from the evaporator through suction line 14. Effect of the differential, i.e. superheat, detected in this manner is transformed into operation of switch 45 to control heater 50. As the superheat increases above a predetermined value, switch 45 closes and heater 50 is energized. Heat introduced by heater 50, together with superheat in the evaporator outlet, volatilizes liquid refrigerant in lower loop 28, and conduit portion 26. This lightens the column of liquid in conduit 26, causing it to rise and flow outwardly of upper portion 24 onto the inner wall of conduit 27. This diverted liquid refrigerant subcools liquid refrigerant flowing through capillary tube 17 of the main conduit, thereby increasing the flow rate capacity of the latter. After a period of such heat exchange, the increased flow rate of refrigerant to the evaporator will result in decreased superheat temperature. Upon sensing of this condition by bulbs 42 and 44, bellows 46, 47 will operate to open switch 45, thus halting flow of the subcooling refrigerant from upper portion 24 onto the inner wall of conduit 27.

In some instances, controlled heater 50 exclusively might supply energy to the vapor lift heat exchange 32, without utilizing superheat from suction line 14. In such an arrangement, bulb 44, vapor filled to some specific saturation temperature, would function to impose a limit on the maximum suction temperature at which heater 50 can be energized. This expedient would impose a corresponding limit on system loading much as the maximum-operating-pressure feature provided in thermal expansion valves.

Figure 4:
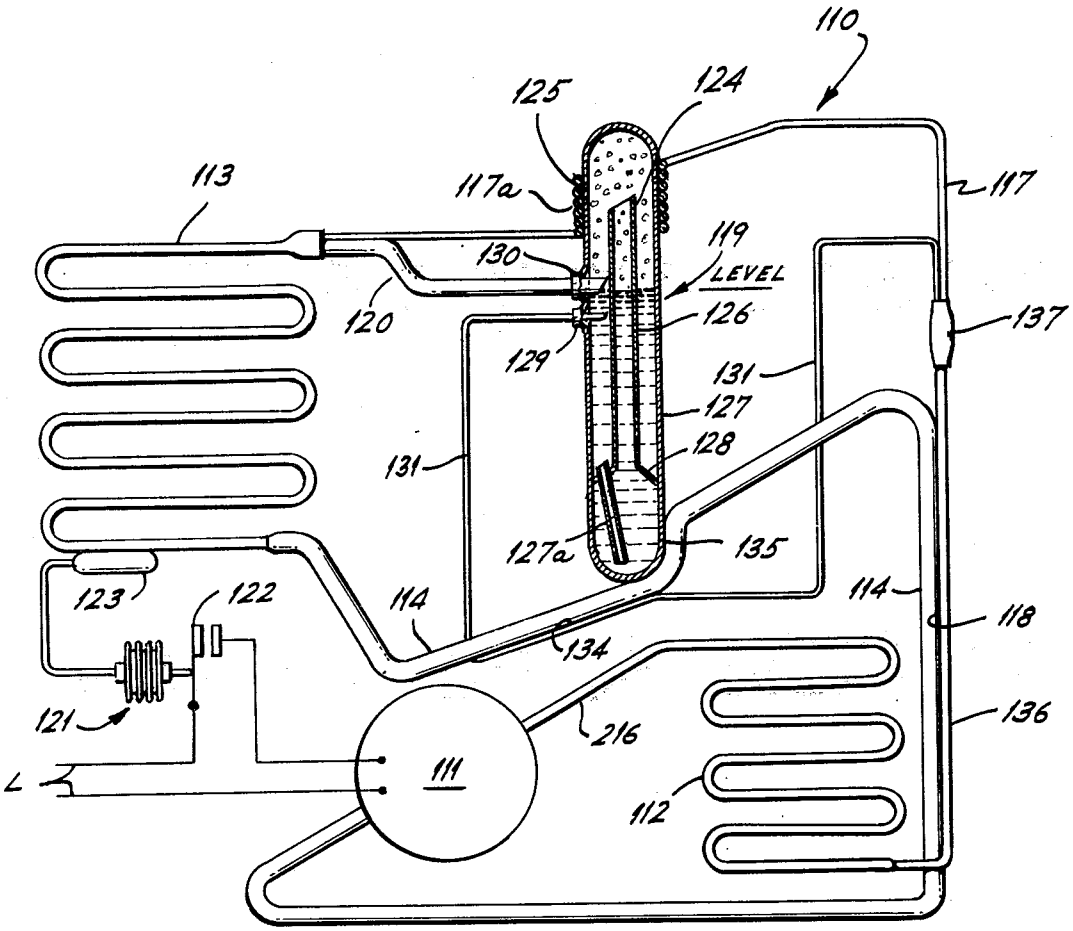
FIG. 4 is a partly sectioned, diagrammatic view of a refrigeration system embodying another form of the invention.

A further modified embodiment of the invention is seen in FIG. 4, wherein a refrigeration system includes a motor-compressor 111, a condenser 112, a conduit 136, a main capillary tube 117, an evaporator 113, and a suction line 114 connected in series refrigerant flow circuit. Conduit 136 is heat exchanged, as seen at 118, with suction line 114.

In especial accordance with the invention, control means 119 includes a pilot capillary tube 131 disposed in parallel refrigerant flow circuit with main capillary tube 117, and leading from the connection 137 of conduit 136 with tube 117. Control means 119 further includes substantially vertically extending, nested inner and outer tubular conduit portions 126 and 127, respectively. The lower region of inner conduit portion 126 is provided with a flared portion 128 extending to the inner surface of conduit portion 127, and an open upper end portion 124 providing communication between upper regions of conduit portions 126 and 127. Fluid communication at the lower ends of conduit portions 126 and 127 is afforded by tube 127*a* which extends through flared portion 128 and functionally is part of conduit portion 127. Heat exchange is provided at 135 between the lower region of conduit portion 127, below flared portion 128, and suction line 114. Evaporator superheat is thus made available to activate the vapor lift of liquid in conduit portion 127 through portion 126, as will be described. Capillary tube 131 communicates with an inlet port 129 provided in conduit portion 127, while an outlet port 130 of the latter is connected by tube 120 to the inlet of evaporator 113. Capillary tube 131 is disposed in heat exchange at 134 with the suction line 114, upstream of or adjacent heat exchange 135.

A thermostat 121 operates a switch 122 in provision of cyclic operation of motor compressor 111, in accordance with temperatures sensed at the outlet of evaporator 113 by sensing bulb 123.

In operation, an elevation in temperature causes switch 122 to be closed, energizing motor compressor 111. Gaseous refrigerant then is caused to flow from evaporator 113, through suction line 114 into compressor 111, where its pressure is raised for flow outwardly to condenser 112. Liquified refrigerant flows into conduit 136 and capillary tube restrictor 117, through a section 117*a* thereof heat exchanged at 125 with the upper section of conduit portion 127, and into evaporator 113.

Meanwhile, liquid refrigerant flows through pilot capillary tube 131 to inlet port 129 of conduit portion 127. Some of this liquid refrigerant flashes into gas, filling the upper regions of conduits 126 and 127. Liquid fills the respective lower regions to the level of outlet port 130, and flows outwardly through tube 120 of the pilot circuit, into the evaporator 113.

Operation in this manner continues until increased superheat develops in the refrigerant leaving evaporator 113. This superheat is absorbed through heat exchange 135, as heat of vaporization by colder liquid refrigerant in conduit 127, causing liquid to be vapor lifted upwardly (FIG. 5) in conduit 126 for discharge onto the upper walls of conduit portion 127. This liquid, in turn, absorbs heat, via exchange 125, from coiled tubing 117*a* of main capillary tube 117, subcooling the liquid refrigerant flowing therein, to increase flow to the evaporator 113. When the evaporator refrigerant supply has been restored, a consequent reduction in superheat at exchange 135 curtails the vapor lifting of liquid in conduit 126 and the absorption of heat through heat exchange 125. These cyclic modes repeat as the system loading demands.

Figure 5:
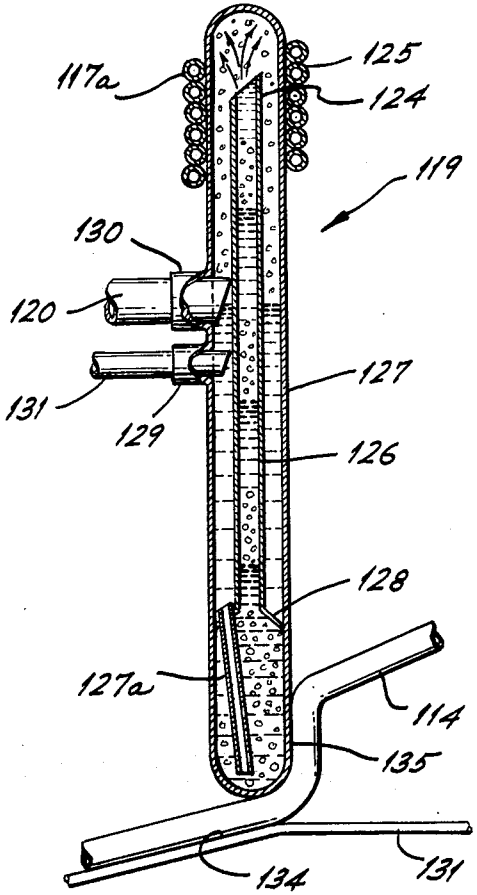
FIG. 5 is an enlarged fragmentary view of a portion of the refrigeration system seen in FIG. 4, and illustrating an operational feature thereof.

The tube-within-tube orientation featured by the embodiment shown in FIGS. 4 and 5 is particularly suited to small, fractional horsepower systems. Further, this design will perform at considerable tilt from the vertical position shown, since the liquid level in tilted conduit portions 126 and 127 would not change adversely in its relationship to the inlet and outlet ports.

Optionally, a refrigerant mist screen or baffle of the type seen at 52 in FIGS. 1 and 2 may be installed in the embodiment seen in FIGS. 4 and 5, just above ports 129 and 130, to obviate thermal effects on heat exchange 125 of random liquid misting and turbulence, when the vapor lift is inactive. Due to the relatively small cross section of conduit portion 127, flare 128 cooperates with tube 127*a* advantageously to insure downflow of liquid phase refrigerant toward the vapor lift heat exchange 135, without opposition from the upflow gaseous phase generated by heat exchange 135. The vapor lift action in conduit portion 126 therefore is more stable and predictable. Other structural means, of course, might be resorted to as substitution for the flare 128 and tube 127*a* combination, in realization of stable and predictable vapor lift action. Further, tube 127*a* can be sized to meter downward flow, thereby limiting the refrigerant available for vapor lift action. This effect subsequently controls the thermal capacity of heat exchange 125, limiting both the subcooling and flow in tube 117, and hence maximum system loading.

In the embodiment shown in FIGS. 4 and 5 the suction line accumulator has been omitted, and it is contemplated that the heat exchange 118 could be omitted if desired. These options, in addition to those described in connection with FIGS. 1 and 2 are, within reason, mutually adaptable to the disclosed embodiments by one skilled in the art.

The present disclosure embraces also the embodiments disclosed in the referenced copending application, and it will be appreciated that any of the embodiments, be it disclosed herein or incorporated by reference, is characterized by provision of control means for modulating the subcooling of liquid refrigerant flowing in a capillary tube serving as the expansion device of a refrigeration system to maintain optimum flow rate in the system, which control means is operable automatically, in response to an increase in evaporator superheat, to increase the subcooling, and provide increased refrigerant flow rate to the evaporator, and, in response to a decrease in the superheat, to decrease the subcooling, and provide decreased refrigerant flow rate to the evaporator.

The above described exchanges of heat are the direct opposite of those derived from the conventional capillary tube-to-suction line heat exchange found in the prior art. In the conventional heat exchange, it is axiomatic that an increase in evaporator superheat will decrease cooling of refrigerant in the capillary tube, while a decrease in evaporator superheat will increase cooling of refrigerant in the capillary tube. This distinction is important to an appreciation of the heat transfer modes and the flow control dynamics characteristic of the embodiments described and claimed herein.

I claim:

1. In a refrigeration system of the type including a compressor, a condenser, a first conduit including a capillary tube, an evaporator, and a second conduit connected in series refrigerant flow circuitry, the improvement comprising control means for modulating the subcooling of liquid refrigerant flowing in said first conduit to maintain optimum flow rate in said system, said control means being operable automatically, in response to an increase in evaporator superheat, to increase said subcooling, and provide increased refrigerant flow rate to said evaporator, and, in response to a decrease in said superheat, to decrease said subcooling, and provide decreased refrigerant flow rate to said evaporator.

2. A system according to claim 1, and characterized in that said control means comprises a pilot conduit disposed in parallel refrigerant flow circuit with said first conduit, said pilot conduit including a thermally responsive refrigerant flow diverter device operable to vary flow of expanded liquid refrigerant in accordance with evaporator superheat, and means affording heat exchange relation between refrigerant flowing through said first conduit and refrigerant flowing through said diverter device.

3. A system according to claim 1, and characterized in that said control means comprises: a third conduit including a capillary tube disposed in parallel refrigerant flow circuit with said first conduit; first and second upstanding tube sections having their upper and lower ends in fluid flow communication, said first tube section being provided with an inlet port for refrigerant from said third conduit, said first tube section also being provided with an outlet port disposed to feed liquid refrigerant to said evaporator, said second tube section being adapted for outlet communication at a level above said outlet port with means in heat exchange with said first conduit; and means operable to volatilize refrigerant for flow in said second tube section in response to evaporator superheat; whereby to effect an outflow of liquid refrigerant from said second tube section for the recited heat exchange.

4. A system according to claim 3, and characterized further in that the recited outlet of said second tube section comprises means disposed and adapted to direct liquid refrigerant flowing from said second tube section onto upper interior surfaces of said first tube section and in that the recited heat exchange comprises said first conduit disposed on the exterior of said first tube section.

5. A system according to claim 3, and characterized further in that said first and second upstanding tube sections are interconnected by upper and lower loop portions, and in that said means operable to volatilize refrigerant comprises disposition of said second conduit in the region of the outlet to the evaporator in heat exchange relation with said lower loop portion in the region of its connection to said second tube section.

6. A system according to claim 3, and characterized further in that said first and second upstanding tube sections are nested, said second tube section having an upper open end portion providing the recited fluid flow communication between upper regions of said tube sections, said second tube section including a flared lower region having means defining a passage extending therethrough in provision of the recited fluid flow communication between lower regions of said tube sections, and in that the recited means operable to volatilize refrigerant includes a portion of said second conduit disposed for heat exchange relation with liquid refrigerant below said flared region of said tube section.

7. A system according to claim 3, and characterized further in that said means operable to volatilize refrigerant comprises electrical heater means disposed and adapted to develop gaseous refrigerant for flow in said second tube section, and means for selectively energizing and deenergizing said heater means, in accordance with the degree of superheat in refrigerant flowing from said evaporator, said last recited means including differential temperature sensing means for the inlet and for the outlet of said evaporator.

8. A system according to claim 7, and characterized further in that said sensing means comprises a pair of sensing bulbs and a pair of opposed bellows having fixed base portions and mutually movable adjacent portions, each bulb connected to one of said bellows, and a switch operable by said mutually movable bellows portions and effective to control energization and deenergization of said heater means.

9. In a refrigeration system of the kind having a compressor-condenser high side, an evaporator-suction line low side, and a first conduit including a main capillary tube connecting said condenser with said evaporator, improved refrigerant flow control means comprising; a second conduit including a pilot capillary tube disposed to receive refrigerant from said high side; refrigerant flow diverter means interposed said second conduit and said low side; and refrigerant passage means adapted to receive liquid refrigerant from said diverter means, in response to evaporator superheat, and return spent gaseous refrigerant to said low side, the recited diverted refrigerant being caused to flow in heat exchange relation with said first conduit and operable to subcool refrigerant flowing therein, whereby to increase the rate of refrigerant flow in said first conduit.

10. In a refrigeration system of the kind having a compressor-condenser high side, an evaporator-suction line low side, and main conduit means including capillary tube means connecting said condenser with said evaporator, improved control means comprising: pilot conduit means including expansion means disposed to receive refrigerant from said high side; passage means interposed between said pilot conduit means and said low side through which liquid refrigerant may be caused to flow for heat exchange with said main conduit means; and means operable in accordance with evaporator superheat to effect refrigerant flow through said passage means to subcool refrigerant flowing in said main conduit means, whereby to increase the refrigerant flow rate in said system and reduce said superheat.

11. A system according to claim 10, and characterized in that said expansion means comprises a capillary tube.

12. In a refrigeration system having a compressor-condenser high side, and conduit means including a capillary tube for delivering expanded refrigerant from said high side to an evaporator-suction line low side, control means comprising: means defining a refrigerant passage disposed in heat exchange relation with said conduit means and providing for refrigerant flow toward said low side; and means operable to deliver expanded liquid refrigerant to said passage in response to an evaporator superheat gain, whereby to subcool refrigerant flowing in said conduit means and increase flow in said system.

13. In a refrigeration system having a compressor-condenser high side, an evaporator-suction line low side, the combination of: means defining a first refrigerant flow path, including capillary tube expansion means, leading from said high side to said evaporator; and means defining a second refrigerant flow path, including expansion means, and means disposed to deliver expanded liquid refrigerant for heat exchange with refrigerant in said first flow path, in response to increasing evaporator superheat, and to return spent expanded refrigerant to said low side, whereby to subcool refrigerant in said first flow path and increase the flow rate in said system.

14. A flow control device for use in a refrigeration system having a compressor, condenser high side, an evaporator, suction line low side, and a conduit including a capillary tube for delivering expanded liquid refrigerant from said high side to said low side, said device comprising: means for collecting liquid refrigerant; means defining a first region above the level of said liquid refrigerant adapted for heat exchange with refrigerant flowing through such conduit; and means defining a second region below the level of said liquid refrigerant from which liquid may be vapor lifted into proximity of said first region by thermal energy to be applied in response to an evaporator superheat gain; said device being ported for the entry of expanded liquid refrigerant from such high side, and ported for the exit of liquid refrigerant toward such low side.

15. A flow control device for use in a refrigeration system having a conduit including a capillary tube for expanding refrigerant flowing from a compressor, condenser high side, to an evaporator, suction line low side, said device comprising: means structured for developing coexisting liquid columns; an inlet port for expanded refrigerant from such a high side; an outlet port for refrigerant flow toward such a low side; and accomodation above said ports for heat exchange with such a conduit, and below said ports for absorbing thermal energy in response to an evaporator superheat gain; said device, when applied to such a system, exhibiting a capability to transport liquid refrigerant into proximity of such a heat exchange, whereby to subcool refrigerant flowing in such a conduit.

16. In a refrigeration system of the kind having a conduit including a capillary tube for expanding refrigerant flowing from a condenser to an evaporator, a method for controlling to optimize refrigerant flow in said system, comprising the steps of: sensing a superheat gain in said evaporator; applying expanded liquid refrigerant in heat exchange with said conduit in response to said gain, and subcooling refrigerant in said conduit to increase flow therethrough; sensing a superheat loss in said evaporator; and reducing activity of said heat exchange in response to said loss, thereby to decrease flow in said conduit.

17. In a vapor compression refrigeration system of the kind providing a supply of condensed liquid refrigerant, and a first passage including capillary tube restrictor means to expand said refrigerant for flow toward an evaporator, suction line low side, the combination of refrigerant flow control means including a second passage disposed in heat exchange relation with said first passage, and means operable, in response to a gain in evaporator superheat, to convey expanded liquid refrigerant from said supply to said second passage, thereby subcooling refrigerant flowing in said first passage and increasing the total refrigerant flow rate in said system.

18. In a vapor compression refrigeration system of the kind providing a supply of condensed liquid refrigerant, and a first passage including capillary tube restrictor means to expand said refrigerant for flow toward an evaporator, suction line low side, the combination of flow control means operable in response to a gain in evaporator superheat to divert an expanded portion of said refrigerant supply into provided second passage means disposed in heat exchange relation with said first passage, whereby to subcool refrigerant flowing in said first passage and increase the refrigerant flow rate in said system.

* * * * *